US006085401A

United States Patent [19]

Dunning

[11] Patent Number: 6,085,401

[45] Date of Patent: Jul. 11, 2000

[54] FLEXIBLE AUTO RIVETER SKIN/ STRINGER ASSEMBLY CELL

[75] Inventor: Vallon E. Dunning, Decatur, Tex.

[73] Assignee: Northrop Grumman Corporation, Los Angeles, Calif.

[21] Appl. No.: 09/287,479

[22] Filed: Apr. 6, 1999

Related U.S. Application Data

[62] Division of application No. 08/536,032, Sep. 29, 1995.

[51] Int. Cl.[7] ..... B25B 27/14

[52] U.S. Cl. ..... 29/281.5; 29/559; 29/281.3; 29/243.53

[58] Field of Search ..... 29/281.5, 559, 29/281.1, 243.53, 281.3

[56] References Cited

U.S. PATENT DOCUMENTS

| | | | |
|---|---|---|---|
| 912,297 | 2/1909 | Ermel . | |
| 2,365,147 | 12/1944 | Speller . | |
| 2,920,783 | 1/1960 | Kipp et al. . | |
| 3,200,487 | 8/1965 | Fluke . | |
| 3,747,193 | 7/1973 | Gregory . | |
| 4,310,964 | 1/1982 | Murphy | 29/281.5 |
| 4,858,289 | 8/1989 | Speller, Sr. . | |
| 4,930,206 | 6/1990 | Suzuki et al. . | |
| 5,142,764 | 9/1992 | Whiteside | 29/559 |
| 5,199,147 | 4/1993 | Whiteside . | |
| 5,201,205 | 4/1993 | Zieve et al. . | |
| 5,231,747 | 8/1993 | Clark et al. . | |
| 5,329,691 | 7/1994 | Roberts et al. . | |
| 5,341,556 | 8/1994 | Shubin et al. . | |
| 5,404,641 | 4/1995 | Bratten et al. . | |
| 5,901,426 | 5/1999 | Okazaki et al. | 29/559 |
| 5,937,502 | 8/1999 | Dunning | 29/559 |
| 5,968,399 | 10/1999 | Takada | 29/559 |

FOREIGN PATENT DOCUMENTS

| | | | |
|---|---|---|---|
| 58-192646 | 11/1983 | Japan | 29/243.5 |
| 1123834 | 11/1984 | U.S.S.R. | 269/25 |

*Primary Examiner*—David A. Scherbel
*Assistant Examiner*—Lee Wilson
*Attorney, Agent, or Firm*—Terry J. Anderson; Karl J. Hoch, Jr.

[57] ABSTRACT

A riveting mechanism (10) is disclosed which includes a riveter (26) having a lower upset post (32) with a vertical member (48) mounting a cylinder (50) having a piston (52). At the end of the piston (52) is a roller (54). The cylinder can be actuated to move the piston and roller so that the roller contacts the outer side (66) of a intermediate arm (64) to move a stringer (14) against the lower upset post (32) to precisely locate the stringer relative the skin and lower upset post for riveting.

18 Claims, 2 Drawing Sheets

FLEXIBLE AUTO RIVETER SKIN/ STRINGER ASSEMBLY CELL

CROSS REFERENCE TO RELATED APPLICATIONS

This is a division of U.S. patent application Ser. No. 08/536,032 filed Sep. 29, 1995.

TECHNICAL FIELD OF THE INVENTION

This invention relates to the assembly of components, and particularly to the precision location to engineering and riveting of aircraft panels to stringers.

BACKGROUND OF THE INVENTION

Aircraft structural components are typically constructed by riveting a skin panel to a series of load bearing stringers with rivets. These rivets are usually installed flush with the outer surface of the skin to reduce drag.

In construction common today, a rigid precision constructed assembly jig or F.A.J., is required to be manufactured for each particular aircraft section. Individual stringers are mounted on the assembly jig and clamped in place. The skin panel is then mounted on the assembly jig. A spray dot template is typically applied to mark the desired rivet pattern between the skin and stringers. The template is removed, cleaned and stored and stabilization holes are formed between the skin and the stringers to receive the fasteners. The skin must be removed in order to debur the holes formed through the skin and the stringers and the skin is then reinstalled and riveted to the stringers. This operation takes considerable time and effort from skilled personnel. It results in a high quality product, but one that is quite expensive. A need exists to reduce the expense of such construction, while maintaining the high quality required by the aircraft industry.

SUMMARY OF THE INVENTION

A jig is provided for positioning a stringer relative to a skin portion to secure the skin and stringer together. The jig includes a fixed member defining a hard locator surface and a movable member urging the stringer against the hard locator surface to position the stringer relative the jig. In another aspect of the present invention, the fixed member is the lower ram of a riveting device, such as the lower upset post. In accordance with another aspect of the present invention, a first cylinder having a piston is mounted to the fixed member, the movable member is mounted on the piston for movement relative the fixed member. In accordance with another aspect of the present invention, the cylinder is mounted on a rotatable mount relative the fixed member.

BRIEF DESCRIPTION OF THE DRAWINGS

For a more complete understanding of the present invention and the advantages thereof, reference is now made to the following description taken in conjunction with the accompanying drawings, in which.

DETAILED DESCRIPTION

Figures 1, 4:
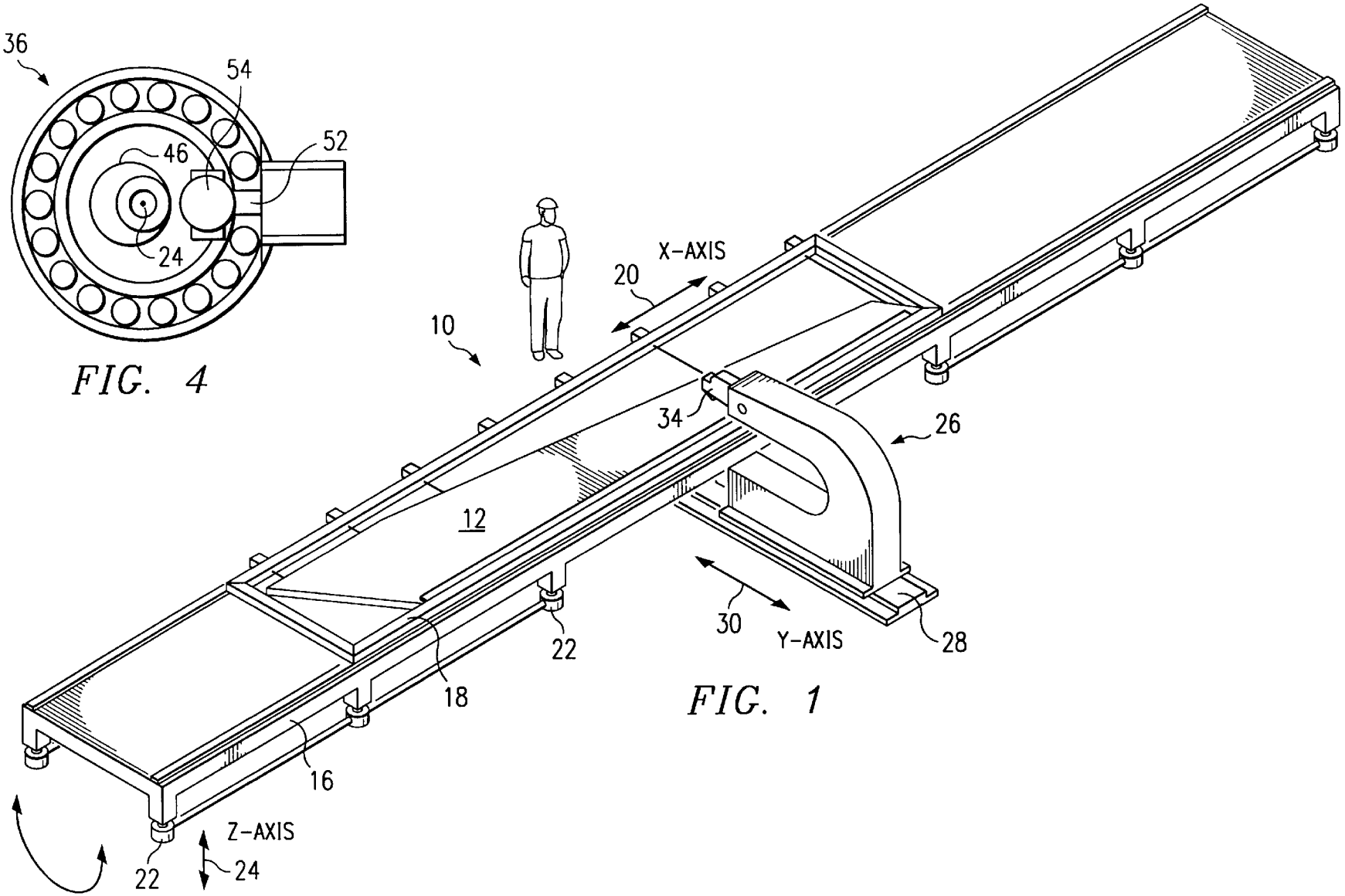
FIG. 1 is a perspective view of a riveting mechanism permitting multi-axis motion.
FIG. 4 is a plan view of the mechanism.
Figure 2:
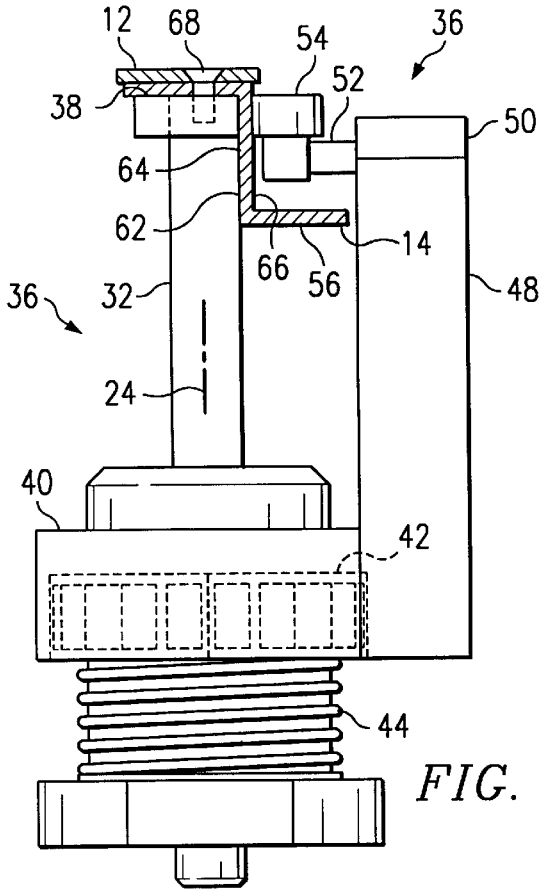
FIG. 2 is a side view of a mechanism forming a first embodiment of the present invention.

With reference now to the drawings, wherein like reference characters designate like or similar parts throughout the several views, FIG. 1 illustrates a riveting mechanism 10 which is capable of riveting a skin 12, typically of an aircraft, to a series of stiffening stringers 14 (as seen in FIG. 2). The mechanism includes a frame 16 which mounts a sliding jig 18 for motion along the frame in an X-axis direction 20. The frame 16 is mounted on a series of positioners 22 which allow the frame to be moved in the vertical or Z-axis direction 24. A riveter 26 is mounted on a slidable base 28 which allows the riveter 26 to move in the Y-axis direction 30 which is perpendicular to both the X-axis and Z-axis. The riveter 26 has a lower upset post 32, as seen in FIG. 2, which extends upwardly from underneath the skin 12. A head 34 above the skin mounts drilling and riveting mechanisms of a type well known in the industry.

In securing a stringer 14 to the skin 12, a rivet is normally installed between the skin and stringer near one end thereof to initially position the stringer. The skin is precisely positioned within the frame 16 and its position relative to the riveter 26 is thus established. However, the position of the stringer 14 is not.

Figure 3:
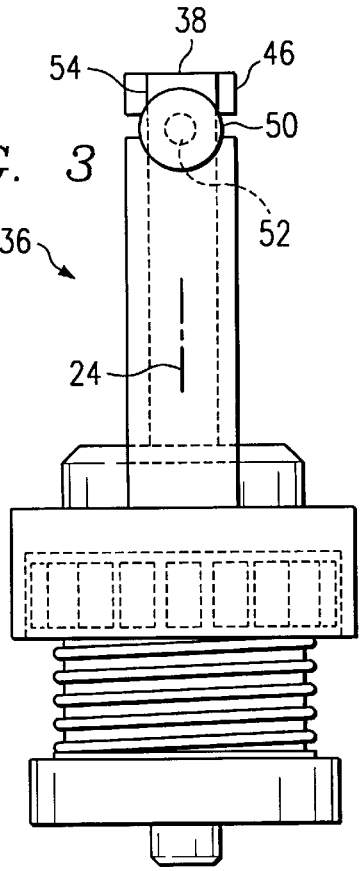
FIG. 3 is an end view of the mechanism.

The mechanism 36 shown in FIGS. 2–4 is capable of precisely positioning the stringer relative the riveter 26 and skin 12 to provide accurate riveting thereto. The mechanism 36 includes the conventional lower upset post 32 of the riveter 26. The upper end of the post 32 defines a hard locator surface 38, also known as the hard stop $ location.

The skin 12 is located in precise orientation to the lower upset post 32 by the frame 16 and jig 18. However, the exact position of the stringer 14 is indeterminate. The post 32 can move vertically along the Z-axis 24 to move up against the stringer and skin and can rotate about the vertical Z-axis 24. The post 32 is rotated to position an eccentric surface 46 on the upper end of the post 32 to a position where the stringer should be located in the plane containing the X and Y axis.

Figure 5:
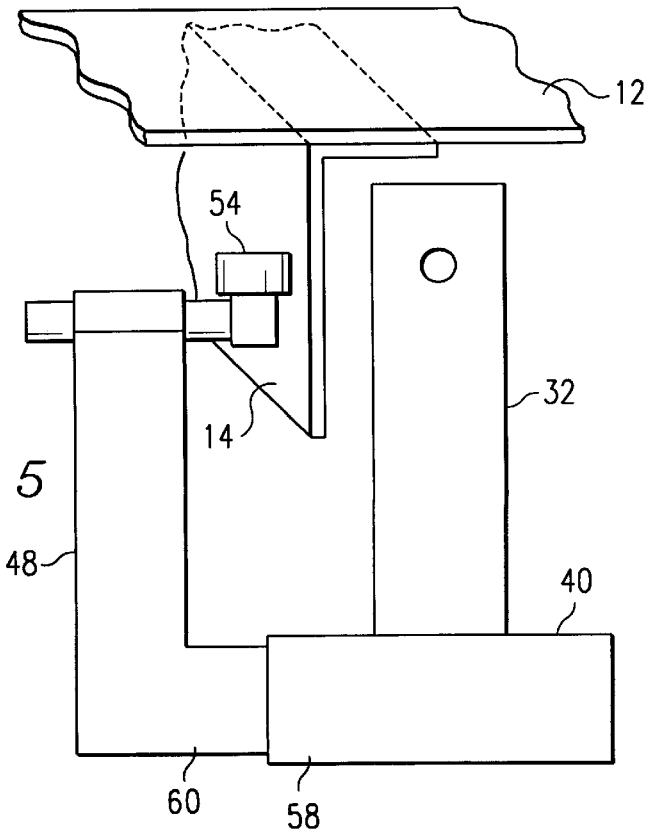
FIG. 5 is a view of a modified mechanism.

A collar 40 is mounted on the post 32 through a bearing 42 and is urged upwardly by a spring 44. A vertical member 48 extends upwardly from the collar 40 to support a cylinder 50 having a piston 52. The cylinder can be operated by hydraulic fluid, air, or any other suitable mechanism. It can also be an electric solenoid actuator. Mounted on the piston 52 is a roller 54 which is mounted for free rotation about the vertical Z-axis 24. To position the stringer 14 relative the skin 12, the piston 52 is initially retracted to draw the roller 54 toward the vertical member 48 and away from the surface 46. The riveter 26 is moved directly under the position the stringer is to be secured to the skin and the lower upset post 32 is raised until the hard locator surface 38 is proximate the skin and in position for riveting. The stringer will generally be in approximately the correct position relative the skin 12 so that the vertical member and roller 54 will clear the lower arm 56 of the stringer 14. If need be, as shown in FIG. 5, the vertical member 48 can be mounted to the collar 40 through a second cylinder 58, with the cylinder 58 mounted on the collar and the vertical member 48 mounted on the piston 60 thereof. This would permit the vertical member 48 and roller 54 to be moved even further away from the lower upset post 32 to orient the post in the desired position in tight quarters between the skin and stringers.

Once in position, the lower upset post 32 can be rotated about the Z-axis to move the eccentric surface 46 to the proper position for the stringer 14 in a manner well known in the industry. It should be noted that the surface 46 may not in fact even contact the stringer as it moves to this position.

The surface simply defines the position where the inner surface 62 of the intermediate arm 64 of the stringer 14 should be positioned. The cylinder 50 can then be activated to extend the piston 52 until the roller 54 comes into contact with the outer side 66 of the intermediate arm 64. The piston and roller then push the stringer into the desired position against the eccentric surface 46 of the lower upset post 32, as seen in FIG. 2, and hold the stringer in this position by maintaining pressure in cylinder 50.

With the skin 12 and stringer 14 properly positioned relative to-the riveter 26, the rivet hole 68 can be bored through both the skin 12 and the stringer 14. Because the lower upset post 32 can provide sufficient clamp up pressure on the skin 12 and stringer 14, the hole 68 can be drilled without the need to subsequently separate the skin and stringer from each other to debur the hole. The riveter 26 then functions to install the rivet and machine flush the end surface of the rivet with the outer surface of the skin to finish the operation.

To rivet the next position, the frame 16, jig 18 and riveter 26 are moved as necessary in the X-axis, Y-axis and Z-axis directions to properly position the lower upset post 32 in the proper position for installing the rivet. Again, the piston 52 can be activated the move the roller 54 against the stringer to properly position the stringer 14 relative to the skin 12 and riveting mechanism 10.

It will be anticipated that the present invention has particular advantages in computer numerical control (CNC) riveting mechanisms.

While a single embodiment of the invention has been illustrated in the accompanying drawings and described in the foregoing detailed description, it will be understood that the invention is not limited to the embodiment disclosed, but is capable of numerous rearrangements, modifications and substitutions of parts and elements without departing from the scope and spirit of the invention.

What is claimed is:

1. A jig for positioning a stringer relative to a skin portion to secure the skin portion and stringer together, comprising:

a fixed member defining a hard locator surface; and a movable member urging the stringer against the hard locator surface to position the stringer relative to the jig, wherein the fixed member is a lower upset post of a riveting machine.

2. The jig of claim 1 wherein the movable member is mounted on the fixed member for rotation about an axis.

3. A jig for positioning a stringer relative to a skin portion to secure the skin portion and stringer together, comprising:

a fixed member defining a hard locator surface; and a movable member urging the stringer against the hard locator surface to position the stringer relative to the jig, wherein the movable member includes a first member, a cylinder mounted on the first member, the cylinder having a piston, a roller mounted at the end of the piston, the piston being extended to engage the stringer to position the stringer relative to the jig.

4. The jig of claim 3 further comprising a second cylinder mounted on the fixed member, the second cylinder having a piston, the movable member mounted on the end of the piston of a second cylinder.

5. A jig for positioning a stringer relative to a skin portion to secure the skin and stringer together, comprising:

a lower upset post, the lower upset post rotatable about a first axis and having a hard locator surface thereon; and a member mounted to the lower upset post, a cylinder mounted on the member, the cylinder having a piston, a roller mounted on the end of the piston, the roller contacting the stringer to urge the stringer against the lower upset post to position the stringer relative to the skin portion for riveting.

6. An apparatus for positioning a stringer relative to a skin portion to secure the skin portion and stringer together with a riveting device, comprising:

a lower upset post, the lower upset post having a hard locator surface, the lower upset post being in a predetermined relationship to the skin portion, the stringer having at least a first portion extending generally parallel to a first plane and a second portion extending at an angle to the first plane, the hard locator surface lying in the first plane and supporting said first portion of the stringer; and a member secured to the lower upset post, the member having a cylinder with a piston, the piston moveable against the second portion of the stringer to move the second portion against the lower upset post in a direction parallel the first plane to precisely position the stringer relative to the lower upset post and skin portion for riveting.

7. The apparatus of claim 6 further comprising a second cylinder mounted on the lower upset post, the second cylinder having a second piston, the member mounted on the second piston.

8. The apparatus of claim 6 wherein said member is mounted on the lower upset post for rotation relative thereto about an axis perpendicular the first plane.

9. The apparatus of claim 6 wherein the lower upset post is rotatable about an axis perpendicular the first plane, said lower upset post defining a surface perpendicular the first plane, the surface lying at varying radiuses from the axis of rotation.

10. The apparatus of claim 6 wherein the piston mounts a rotating wheel thereon contacting the stringer.

11. The apparatus of claim 6 wherein the lower upset post has an eccentric surface in opposition to the piston of the cylinder, the eccentric surface extending generally perpendicular the first plane, the eccentric surface varying in distance from an axis perpendicular the first plane.

12. An apparatus for positioning a stringer relative to a skin portion to secure the skin portion and stringer together, comprising:

a lower upset post having a hard locator surface extending generally perpendicular a first axis, the lower upset post positioned in a predetermined relationship to the skin portion; and a member secured to the lower upset post, a cylinder being mounted on the member and having a piston, the piston movable between a first retracted position and a second extended position, the piston moving from the extended position positioning the stringer in a direction generally perpendicular to the first axis against the lower upset post to precisely position the stringer relative to the lower upset post and skin portion for riveting.

13. The apparatus of claim 12 wherein the member is mounted on the lower upset post for rotation relative thereto.

14. The apparatus of claim 12 wherein the lower upset post is rotatable about an axis, said lower upset post defining a surface being a non uniform distance from the axis contacting the stringer.

15. The apparatus of claim 12 further having a roller mounted on the piston, said roller rotatable about an axis parallel the first axis.

16. The apparatus of claim 12 wherein the lower upset post mounts an eccentric surface on an end thereof proximate the stringer to vary the position of the stringer relative to the skin portion.

17. The apparatus of claim 12 further including a second cylinder mounted on said lower upset post and having a second piston, the member mounted on said second piston, the second piston movable between a first retracted position and a second extended position, the piston of said cylinder being spaced further from the lower upset post with the second piston in the extended position.

18. The apparatus of claim 12 wherein the lower upset post is rotatable about a first axis.

* * * * *